United States Patent [19]

Ninet et al.

[11] 4,436,454

[45] Mar. 13, 1984

[54] DEVICE FOR POSITIONING AN OFF-SHORE PLATFORM ON ITS SUPPORT STRUCTURE

[75] Inventors: Jean-Louis Ninet; Robert Vaillant, both of Nantes, France

[73] Assignee: Ateliers et Chantiers de Bretagne-ABC, Nantes, France

[21] Appl. No.: 295,456

[22] Filed: Aug. 24, 1981

[30] Foreign Application Priority Data

Dec. 23, 1980 [FR] France ..... 80 27347

[51] Int. Cl.[3] ..... E02D 21/00

[52] U.S. Cl. ..... 405/204; 405/195; 405/203

[58] Field of Search ..... 405/195, 196, 197, 203, 405/204, 209

[56] References Cited

U.S. PATENT DOCUMENTS

| | | | |
|---|---|---|---|
| 2,907,172 | 10/1959 | Crake | 405/209 |
| 2,984,075 | 5/1961 | Suderow | 405/197 |
| 3,485,051 | 12/1969 | Watkins | 405/204 |
| 3,734,220 | 5/1973 | Smith | 405/198 |
| 3,736,756 | 6/1973 | Lloyd | 405/204 |
| 4,073,155 | 2/1978 | Schiemichen | 405/197 |
| 4,222,683 | 9/1980 | Schaloske et al. | 405/203 |
| 4,252,469 | 2/1981 | Blight | 405/204 |

*Primary Examiner*—Dennis L. Taylor
*Assistant Examiner*—John A. Gungor
*Attorney, Agent, or Firm*—Sughrue, Mion, Zinn, MacPeak & Seas

[57] ABSTRACT

A device for positioning an off-shore platform (1) on a previously-installed support structure. Said platform has support piles (6) designed to rest on legs (4) of the support structure.

The device includes means for bringing said support piles towards said legs which are provided with centering cones (5). Each pile is constituted by a tube containing a rod (13) associated with a damping unit (8). The lower portion of the rod (13) has a centering pin (16) and extends below the lower end of the pile in the damping unit rest position.

9 Claims, 5 Drawing Figures

DEVICE FOR POSITIONING AN OFF-SHORE PLATFORM ON ITS SUPPORT STRUCTURE

A device for positioning an off-shore platform on its support structure.

BACKGROUND OF THE INVENTION

The invention applies to any off-shore platform or similar structure which is designed to be placed on a stationary support structure already in place. There is thus a problem of swell at the time when the platform is installed on said support structure, whether the platform itself floats, or is transported by a barge, or is suspended from the hook of a floating crane, etc.

The platform has piles which, at the end of the operation, must rest on determined locations of the support structure and which must be welded thereto.

The swell makes this platform installing operation particularly difficult because of the danger of the platform striking against its support structure and causing serious damage. Further, welding is also a tricky operation because of the load weight which may be very great.

Preferred embodiments of the present invention make it possible to install such a platform without damaging it by impacts due to the swell, and then to weld the platform to its support structure under very good conditions.

SUMMARY OF THE INVENTION

The present invention provides a device for positioning an off-shore platform on a previously-installed support structure, said platform having support piles designed to rest on legs of the support structure, wherein the device includes means for bringing said piles towards said legs which are provided with centering cones, and wherein each pile is constituted by a tube containing a rod associated with a damping unit, the lower portion of the rod having a centering pin and extending below the lower end of the pile in the damping unit rest position.

Preferably the device includes means for controlling the sliding of the rod in the pile.

Advantageously, the means for controlling the sliding of the rod in the pile includes a jack.

According to a particular embodiment, the jack is associated with a set of removable shims which bear the forces applied to the jack.

Said means for bringing said piles towards their legs may include a mechanism which allows the platform to move relative to its piles.

Advantageously, the damping unit is constituted by a mass of resilient material.

BRIEF DESCRIPTION OF THE DRAWINGS

An embodiment of the present invention is described by way of example with reference to the accompanying drawings in which.

DESCRIPTION OF THE PREFERRED EMBODIMENTS

Figure 1:
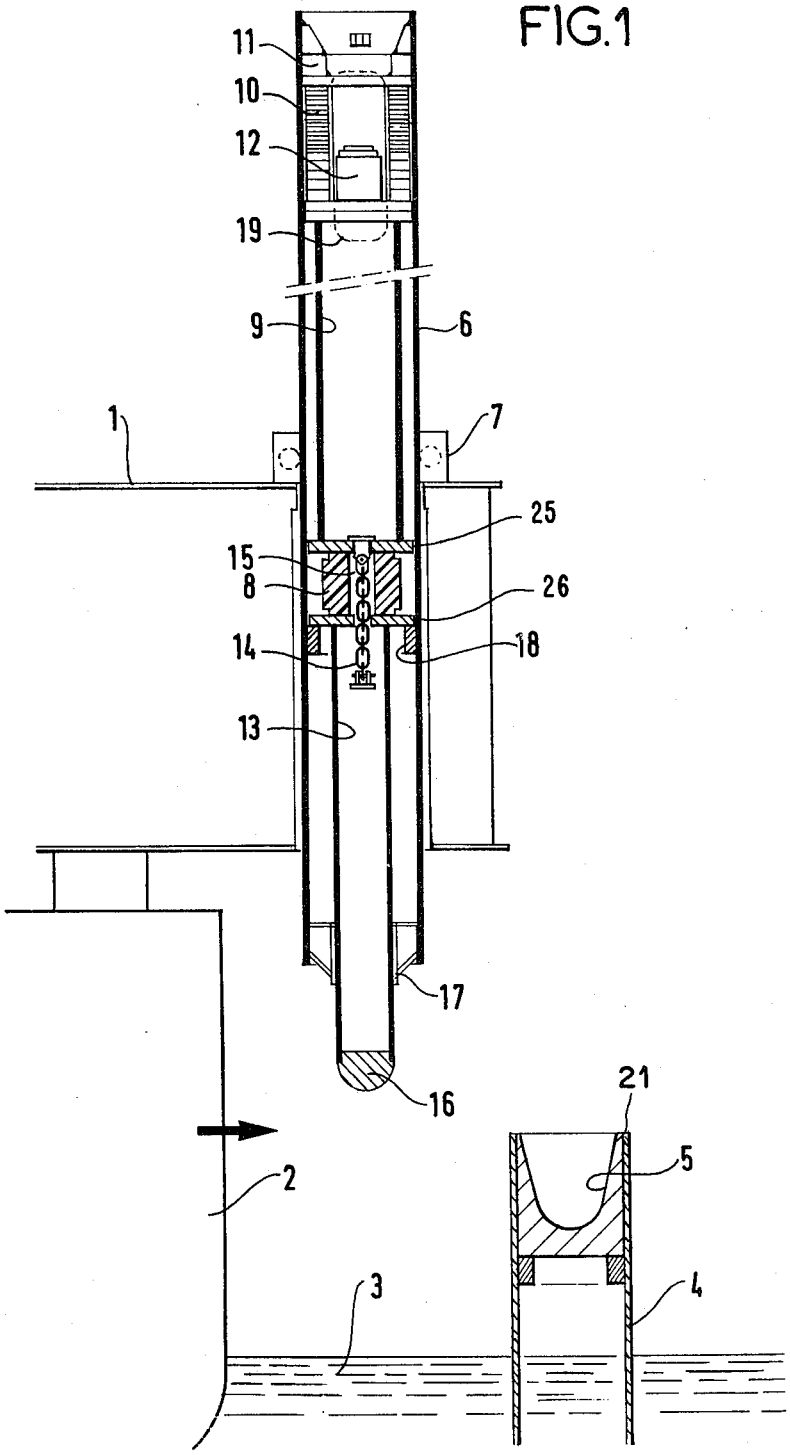
FIGS. 1 to 4 are similar vertical sectional, partial schematic views which show a device for positioning an off-shore platform at various successive steps in use.

FIG. 1 is a partial schematic illustration of a platform 1 borne, in the particular case of the present example, by a transport barge 2. A structure designed to support the platform 1 is installed on the bed of the sea 3. This structure has emerging legs—four, for example—one of which, referenced 4, is shown in the figure and is topped by a centering cone 5.

A pile 6 integral with the platform 1 corresponds to each leg 4. Conventional means 7 on the platform allow the pile 6 to move vertically relative to the platform 1 and allow the pile 6 to be locked in a fixed position. Said pile is designed to bear against the top 21 of the leg 4. The pile 6 is constituted by a tube inside which there is a damping unit 8 made, for example, of an elastomer. The damping unit 8 is topped by a rod upper section 9 which bears against shims 10, which shims bear against stops 11 integral with the pile 6. The shims 10 can be inserted and removed by means of a jack 12 which is thus subject to force for short periods only. A rod lower section 13 is connected to the rod upper section 9 by a chain 14 which passes through an orifice 15 in the damping unit 8 is located below said damping unit. An upper plate 25 rests on damping unit 8 and abuts the lower end of upper section 9 of the rod. A lower plate 26 underlies the damping unit 8 and is fixed to the upper end of rod section 13. The use of the chain will be explained hereinafter. The rod section 13 ends in a centering pin 16 and it is guided at 17. Lower stops 18 limit the downward movement of the rod 13. The shims 10 can be removed through a slot 19 in the upper portion of the pile 6. The assembly constituted by the jack 12 and the shims 10 thus allows the sliding of the rod section 13 in the pile 6 to be controlled.

The device operates as follows:

In FIG. 1, during transport, the damping unit 8 is partially compressed, e.g. by a weight of one hundred tons if the weight of the platform is sixteen hundred tons, i.e. four hundred tons per leg 4. For example, an elastomer block seven hundred millimeters high is used and it is compressed to about seventy five millimeters. This compression is effected by actuating the jack 12 and then adding the shims 10. This partial compression, during transport, aims to provide proper support of the assembly. The barge 2 is set between the four legs 4 so as to place the piles 6 just above the legs.

Figure 2:
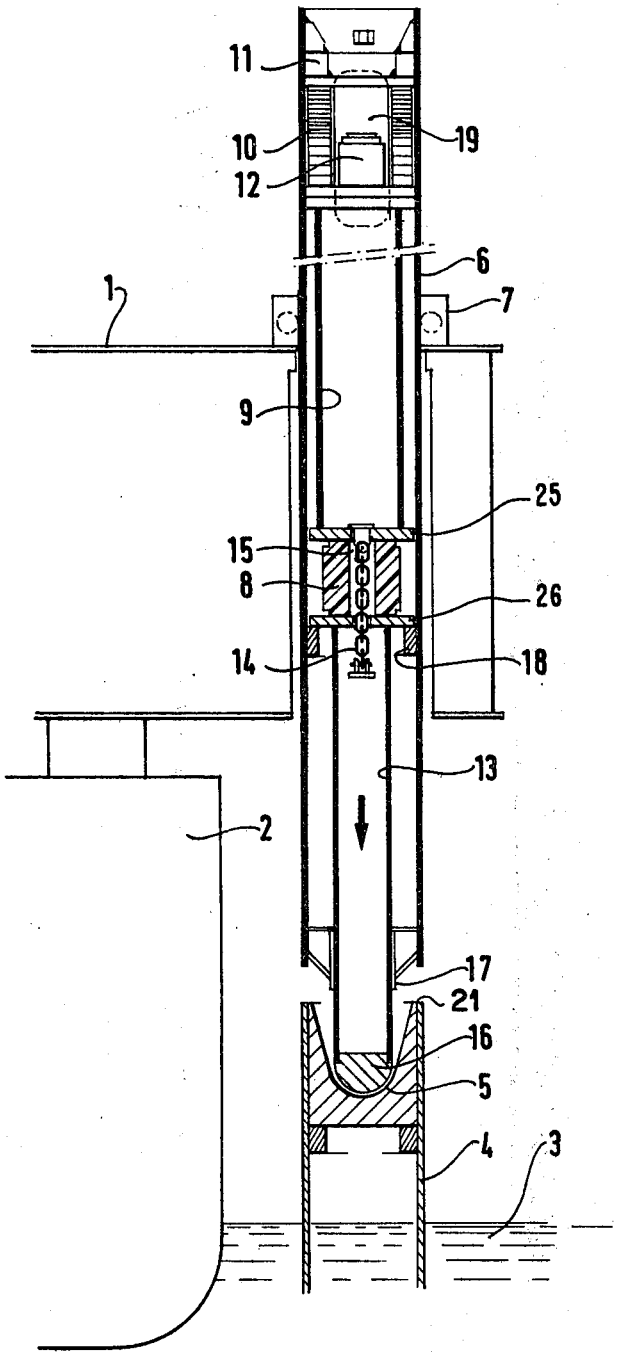
Figure 3:
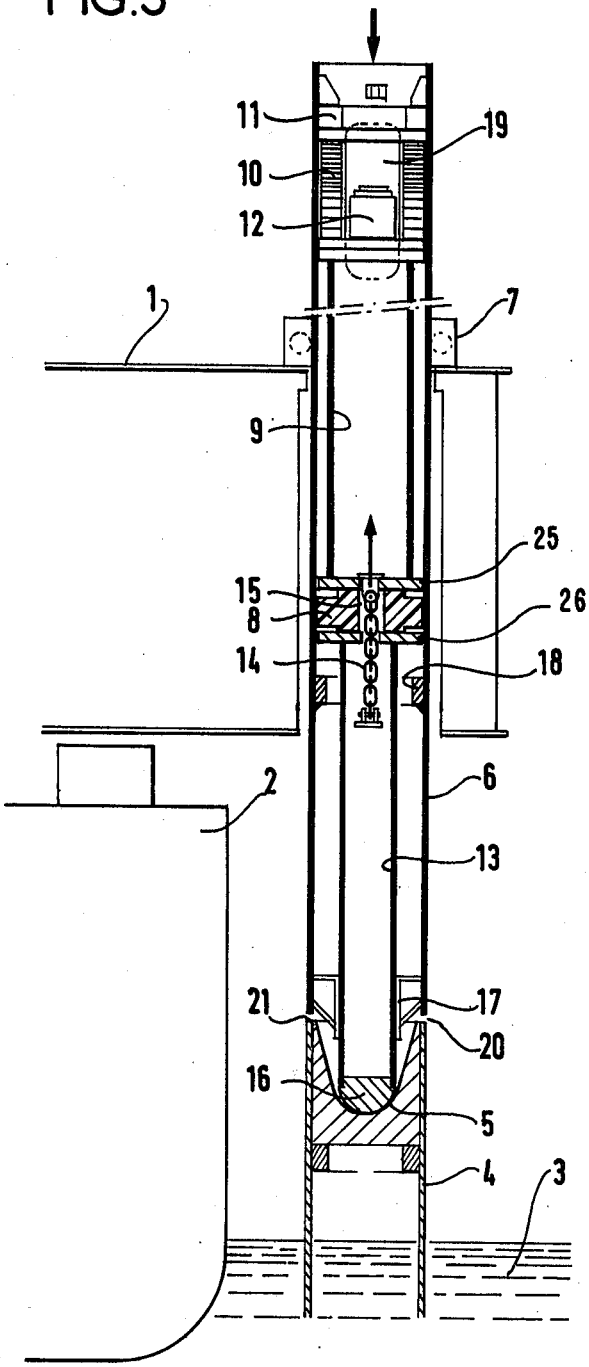
Figure 4:
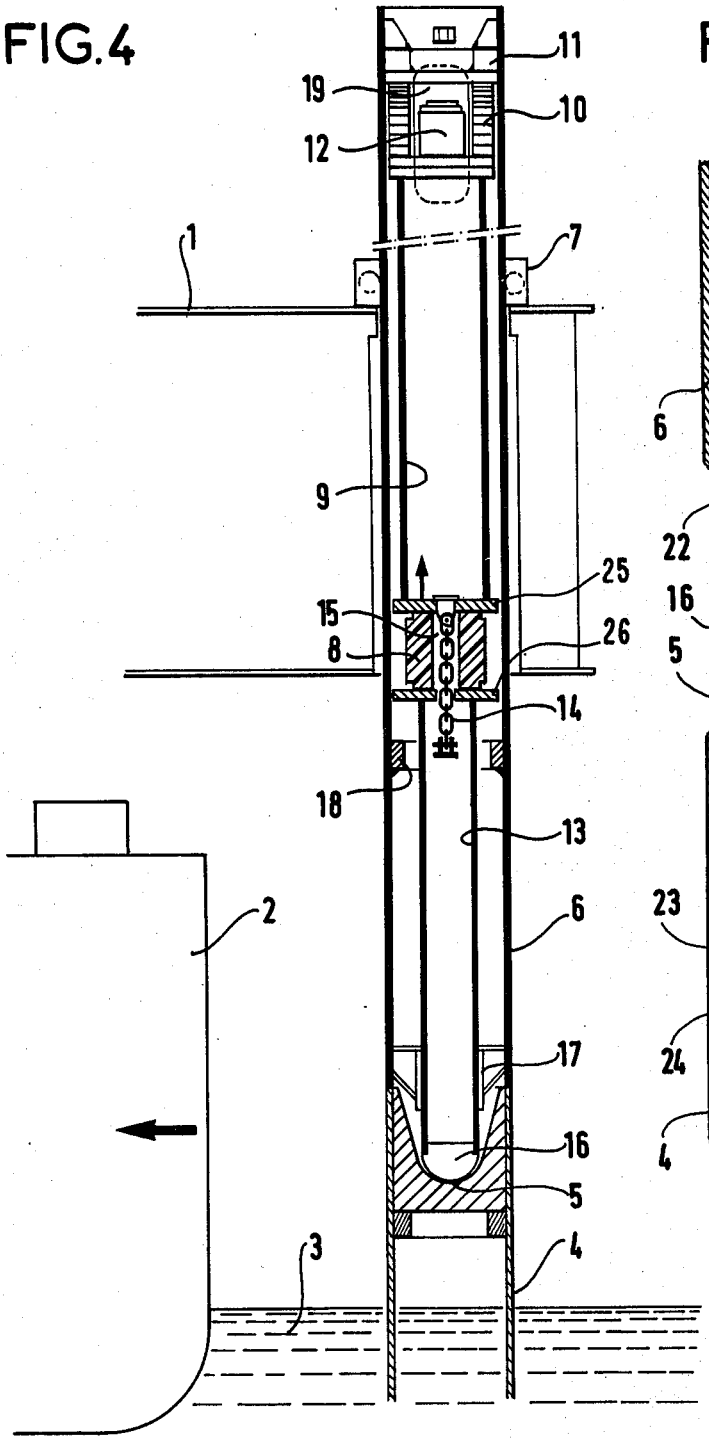

In FIG. 2, firstly, the pressure of the damping unit 8 is released by removing a number of shims 10 so as to reset the damping unit head room at seven hundred millimeters; then, the pile 6 is lowered by means of a machine 7. In FIG. 3, operation of the hoisting machine 7 continues; the rod section 13 bears against the bottom of the centering cone 5; the damping unit 8 is completely compressed under the four hundred tons of the platform 1 which begins to move off the barge 2. When the damping unit is completely compressed, it then measures, for example, four hundred and fifty millimeters, the pile 6 not coming into contact with the top of the leg 4; there remains a safety clearance 20 of about a hundred and fifty millimeters, for example. Final positioning is completed by means of the jack 12 by applying pressure so as to remove a number of shims which corresponds to the height of the clearance 20 and to the difference in length between the released damping unit and the compressed damping unit so as to set it in the position illustrated in FIG. 4 where there is no more clearance, the pile 6 resting in the centering cone 5 and where the damping unit 8, being relieved, has resumed its initial height. Then, the centering cone 5 can be welded to the pile 6 and the platform 1 can be hoisted up the pile by means of the hoisting machine 7.

One particular advantage of controlling the sliding of the rod section 13 in the pile 6 by means of the jack 12 and of the shims 10 is that besides allowing final positioning of the pile 6 against the leg 4 without any impact, it allows the pile 6 to be welded to the leg 4 while only part of the load of the platform is resting on the upper portion 21 of the leg 4. This makes it possible for the welding to be performed under very good conditions. This is done by doing welding before completely decompressing the damping unit 8 or even while there is still some clearance 20.

Figure 5:
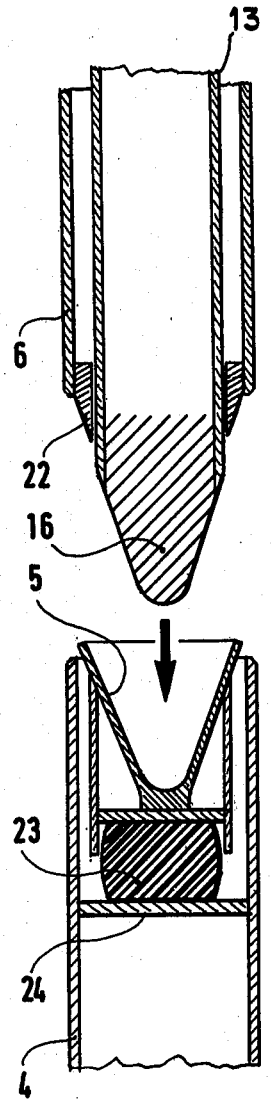
FIG. 5 is a vertical part of an advantageous variant of a part of the device in accordance with the invention.

In a particularly advantageous variant illustrated in FIG. 5, the lower end of the pile 6 is equipped with a forming system 22 which accessorily serves as a guide for the rod section 13. This forming system is constituted for example by a solid conical part. The centering cone 5 is resiliently installed in the leg 4 by means of a damping unit 23. A stop 24 limits the travel of the centering cone 5. During the platform installing process, the centering cone 5 abuts when the load is less than that of the platform. When the centering cone 5 is retracted, the upper end of the leg 4 is free and the forming system 22 can enter therein. During the pile 6 positioning step, the clearance 20 (FIG. 3) between the two chamfers can be reduced at will so as to be able to perform full-penetration welding, the forming system 22 then serving as a welding support.

Once the installing operation is ended, the pile 6 can be cut at the slot 19 and the upper portion of the pile can be removed by means of a hoisting system; then the jack and the shims are recovered and the tube 9 is extracted, drawing with it the damping unit 8 and the rod section 13 by means of the chain 14.

We claim:

1. A device for positioning an off-shore platform on a previously-installed support structure, said support structure including vertically upstanding legs, said platform having support piles designed to axially align with and to rest on the legs of the support structure, said platform further comprising means for moving said piles vertically to move said piles downwardly towards said legs and for locking said piles at an axially displaced position with respect to said platform, said legs including upwardly open centering cones, each pile being constituted by a hollow tube, a rod slidably positioned coaxially within said tube, said rod terminating at its lower end in a centering pin for reception within said centering cone of said leg, a resilient, compressible shock-absorbing component fixed to said rod and operatively interposed between said rod and said hollow tube, and means for effecting controlled sliding of said rod bearing said reslient, compressible shock-absorbing component within said hollow tube to effect precompression of said shock-absorbing component during transport of said platform to the situs of said previously installed support structure and for facilitating final positioning of said pile against said leg without impact and for taking up the load of the platform as transmitted to the leg to facilitate welding of said pile to said leg at the interface between the pile hollow tube and said leg about said centering cone.

2. A device according to claim 1, wherein said means for effecting controlled sliding of the rod within said pile comprises a jack acting on one end of said rod, and wherein said compressible shock-absorbing component is mounted intermediate said jack and said centering pin carried by said rod.

3. A device according to claim 2, wherein said hollow pile includes an upper stop fixedly mounted thereto at the upper end thereof, a lower stop fixedly mounted internally of said hollow pile at a lower level with respect to said upper stop, said rod comprises an upper section and a lower section, first and second plates are interposed between said rod sections, said shock-absorbing component is positioned between said upper section and said lower section, said first plate bearing said shock-absorbing component abuts the lower stop and is fixed to the upper end of said lower section, said upper section abuts said second plate positioned above said shock-absorbing component, and a set of removable shims are selectively interposed between the upper end of said upper section and said upper stop such that said jack acting on the upper end of said upper section causes said upper section to be depressed within said hollow pile and to precompress said shock-absorbing component, and wherein said removable shims interposed between the upper end of said hollow tube and said upper stop maintain the compression of the shock-absorbing component by bearing the forces applied by the jack to the compressible shock-absorbing component through said upper section.

4. A device according to claim 1, wherein said means for driving said piles vertically relative to said platform towards said legs includes a mechanism which allows the platform to move relative to said piles.

5. A device according to claim 1, wherein said shock-absorbing component is constituted by a mass of resilient material.

6. A device acording to claim 1, wherein said centering cones in said legs are mounted to said legs via a damping unit to facilitate engagement between the centering cones and the centering pins of said legs and said hollow rods, respectively.

7. A device according to claim 1, wherein the end of each support pile has a forming device designed to enter said legs when the piles are finally positioned thereon.

8. A device according to claim 3, wherein said shock-absorbing component comprises an elastomeric mass interposed between said second plate abutting the lower end of said upper section and said first plate fixed to the upper end of said lower section.

9. A process for positioning of an off-shore platform on a previously installed support structure, said support structure including vertically raised legs, said platform having support piles corresponding to said legs and intended to rest on said legs of said support structure, and means for mounting said piles on said platform for vertical movement to said platform and for selective locking of said piles in position on said platform, and wherein each pile is constituted by a tube bearing a slidable rod abutting a shock-absorbing component and having means for controlled sliding of the rod in said pile, and wherein the lower part of the rod contains a centering pin extending beneath the lower end of the pile for reception within a support cone borne by said leg, said process comprising, during transport of said platform:

partially compressing said shock-absorbing component by the weight of the platform and by operation of said means for effecting controlled sliding of said rod within said pile, partially releasing the precompression of said shock-absorbing component when the piles are aligned with said legs, driving said piles vertically downwardly relative to said platform to engage the centering pin of said hollow rod with the support cone of said leg, while completely compressing said shock-absorbing component, effecting controlled sliding of said rod to partially release the compressed shock-absorbing component and to remove the clearance between the pile and said leg, welding said pile to said leg, cutting said pile subsequent to platform installing, and removing and hoisting said hollow rod and said shock-absorbing component from the interior of said pile for subsequent re-use without affecting the positioned off-shore platform relative to the support structure.

* * * * *